US006736661B2

(12) United States Patent
Homer

(10) Patent No.: US 6,736,661 B2
(45) Date of Patent: May 18, 2004

(54) COLLAPSIBLE RJ11/RJ45 CONNECTOR FOR TYPE II PC CARD EXTENSION CORD APPLICATION

(75) Inventor: Steven S. Homer, Tomball, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/356,434

(22) Filed: Jan. 31, 2003

(65) Prior Publication Data

US 2003/0114040 A1 Jun. 19, 2003

Related U.S. Application Data

(62) Division of application No. 09/908,035, filed on Jul. 18, 2001, now Pat. No. 6,679,718.

(51) Int. Cl.[7] ..... H01R 13/625

(52) U.S. Cl. ..... 439/344; 439/676; 439/501

(58) Field of Search ..... 439/344, 676, 439/501

(56) References Cited

U.S. PATENT DOCUMENTS

| | | | | | |
|---|---|---|---|---|---|
| 5,241,593 | A | * | 8/1993 | Wagner | 379/438 |
| 6,045,393 | A | | 4/2000 | Alpert | 439/418 |
| 6,254,025 | B1 | * | 7/2001 | Liao | 242/378.1 |
| 6,416,355 | B1 | * | 7/2002 | Liao | 439/501 |
| 6,619,980 | B1 | * | 9/2003 | Hsiao | 439/501 |

* cited by examiner

*Primary Examiner*—Truc Nguyen

(57) ABSTRACT

A collapsible communication connector that is movable between a compact collapsed configuration and an expanded operational configuration. The collapsible communication connector has an attachment assembly, which is movably coupled to an electrical contact panel. The attachment assembly is expanded outwardly from the electrical contact panel to facilitate mechanical coupling of the collapsible communication connector with a counterpart receptacle

19 Claims, 5 Drawing Sheets

COLLAPSIBLE RJ11/RJ45 CONNECTOR FOR TYPE II PC CARD EXTENSION CORD APPLICATION

This application is a divisional of application Ser. No. 09/908,035 filed on Jul. 18, 2001 now U.S. Pat. No. 6,679,718.

FIELD OF THE INVENTION

The present technique relates generally to electrical connectors and, more particularly, to input/output and communication connectors. The present technique provides a system and method for reducing space consumption of an electrical connector by utilizing a collapsible connector assembly.

BACKGROUND OF THE INVENTION

This section is intended to introduce the reader to various aspects of art, which may be related to various aspects of the present invention, which are described and/or claimed below. This discussion is believed to be helpful in providing the reader with background information to facilitate a better understanding of the various aspects of the present invention. Accordingly, it should be understood that these, statements are to be read in this light, and not as admissions of prior art.

Electrical connection assemblies are utilized in electrical systems, computer systems, and various other electrical and computing components and devices. These electrical connection assemblies typically have a fixed geometry and configuration that utilize a male/female attachment mechanism to provide an electrical connection. For example, the connection assemblies may have a male connector that is insertable into a receptacle or female connector. Unfortunately, many of these electrical connectors have a geometry or configuration that may not be suitable for compact applications, such as personal digital assistants (PDAs), laptop computers, notebook computers, and various other electronics and computing devices that have a limited space for electrical connectors and ports. For example, an RJ11 or RJ45 connector may be desired in a particular computing component or device, yet the space limitations of the device may not permit the utilization of the desired connector due to the size and configuration of the connector.

Accordingly, a system and method is needed for reducing the size and space consumption of electrical connectors to facilitate use in compact electronics and computing components.

SUMMARY OF THE INVENTION

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

An aspect of the present technique provides a communication connector. The communication connector comprises an electrical connector panel having an electrical contact and a conductor coupled to the electrical contact. A mechanical connector panel is also collapsibly coupled to the electrical connector panel.

Another aspect of the present technique provides a space saving system for providing a communication connection.

The space saving system comprises a collapsible communication connector. A communication cable is also coupled to the collapsible communication connector. The space saving system also includes a reel assembly having the communication cable removably wound about the reel assembly.

Another aspect of the present technique provides a method of forming a communication connector. The method comprises the act of collapsibly coupling an attachment assembly to a communication contact assembly to form a collapsible communication connector.

Another aspect of the present technique provides a method of using a communication connector. The method comprises the act of manipulating a collapsible communication connector between a collapsed configuration and an open configuration. The collapsed configuration has a compact profile, while the open configuration has a mechanical attachment portion oriented for coupling with a counterpart communication receptacle.

BRIEF DESCRIPTION OF THE DRAWINGS

Exemplary embodiments will hereafter be described with reference to the accompanying drawings, wherein like reference numerals denote like elements, and.

DETAILED DESCRIPTION OF SPECIFIC EMBODIMENTS

One or more specific embodiments of the present invention will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
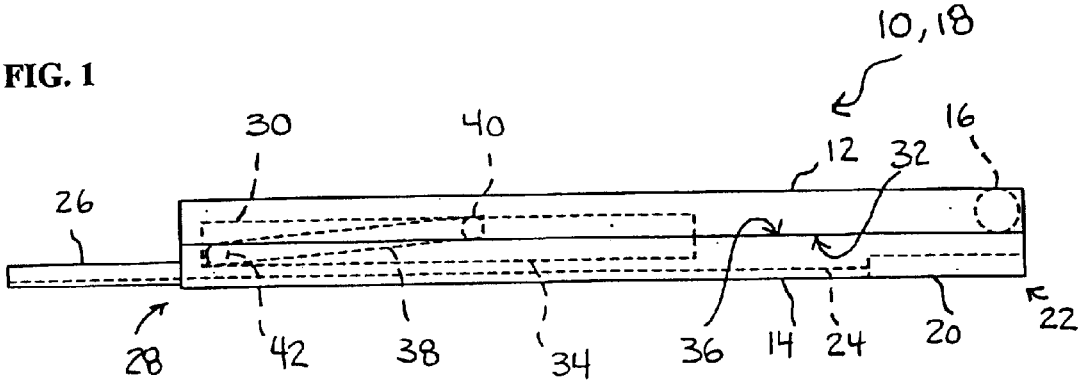
FIG. 1 is a side view of an exemplary collapsible connector in a closed configuration.
Figure 2:
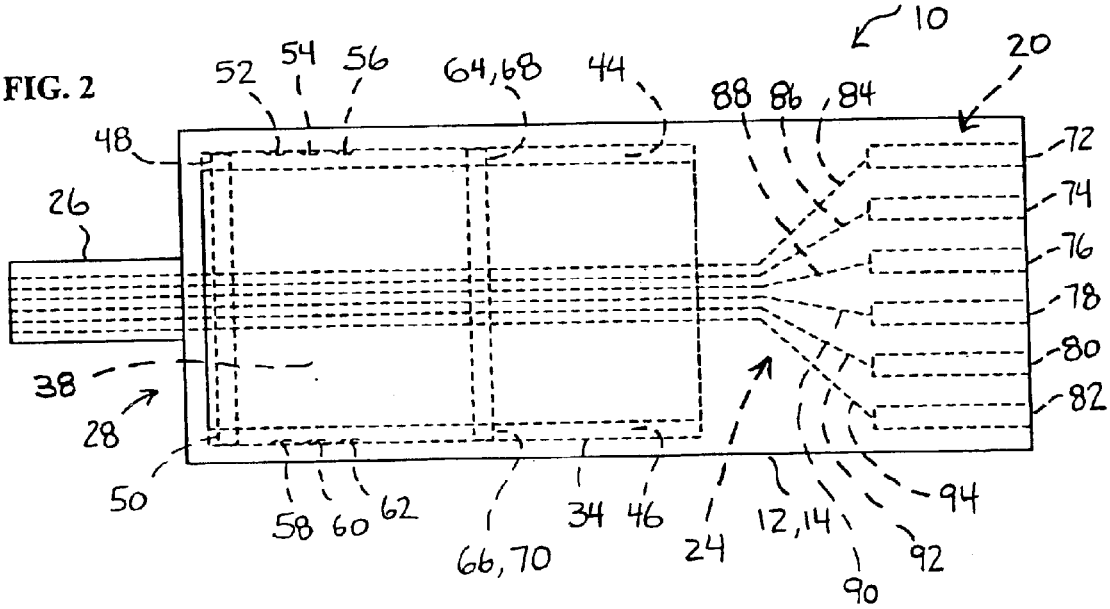
FIG. 2 is a top view of the collapsible connector illustrating a linear positioning assembly and electrical conductor layout.
Figure 3:
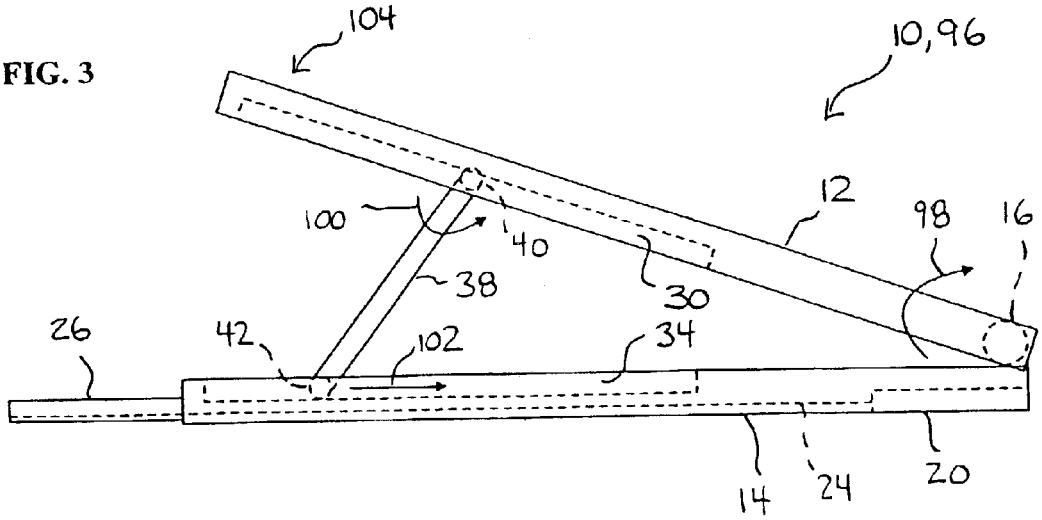
FIG. 3 is a side view of the collapsible connector in an open configuration having a top portion rotated about a hinge structure disposed between the top portion and a base portion, and also having a connector arm rotatably coupled to the top portion and linearly movable along the linear positioning assembly of the base portion.

The present technique is directed to the compact electrical connectors and input/output connectors by providing a collapsible structure for the electrical connector. As illustrated in FIGS. 1–3, a collapsible connector 10 is provided with a top portion 12 rotatably coupled to a base portion 14 via a hinge structure 16. FIG. 1 is a side view of the collapsible connector 10 in a closed configuration 18, which has the top portion 12 rotated about the hinge structure 16 to a position adjacent the base portion 14. As illustrated, the base portion 14 has a set of electrical contacts 20 disposed on a front bottom portion 22 of the base portion 14. The electrical contacts 20 are coupled to a set of conductors 24 that extend through the base portion 14 to a cable 26 disposed at a rear 28 of the base portion 14. The collapsible connector 10 also has a recess 30 extending along an inner portion 32 of the top portion 12 and has a linear positioning assembly 34 extending along an inner portion 36 of the base portion 14. A connector arm 38 is also disposed between, and movably coupled to, the top portion 12 and the base portion 14 to support an open configuration of the collapsible connector 10. The connector arm 38 is rotatably coupled to the top portion 12 at a pivot joint 40 in the recess 30, while the connector arm 38 is movably coupled to the base portion 14 via a pivot joint 42 that is slidably and rotatably disposed within the linear positioning assembly 34. The recess 30 is provided to allow the connector 38 to fit in between the top portion 12 and the base portion 14 in the closed configuration 18. The collapsible connector 10 also may have the pivot joints 40 and 42 disposed in any suitable location along the top portion 12 and the base portion 14 and may have any suitable configuration of linear positioning assemblies and rotational assemblies on either one of the top portion 12 and the base portion 14.

The linear positioning assembly 34 and the electrical scheme of the collapsible connector 10 are illustrated in FIG. 2, which is a top view of the collapsible connector 10. As illustrated, the linear positioning assembly 34 has lateral slots 44 and 46 disposed in opposite sides of the base portion 14 for movably retaining portions 48 and 50 of the pivot joint 42 for linear and rotational movement within the lateral slots 44 and 46. The lateral slots 44 and 46 also may have a plurality of protruding portions, or other snap fit mechanisms, for locking the pivot joint 42 and the portions 48 and 50 at desired locations along the lateral slot 46. For example, protruding portions 52, 54, and 56 may be disposed in the lateral slot 44, while protruding portions 58, 60, and 62 may be disposed in the lateral slot 46 opposite from the protruding portions 52, 54, and 56. Accordingly, the pivot joint 42 and the corresponding portions 48 and 50 may slide along the lateral slots 44 and 46 into the areas adjacent the protruding portions 52 and 58, 54 and 60, or 56 and 62 to secure the connector 38 and the pivot joint 42 at the desired position for an open orientation of the collapsible connector 10. A variety of other locking or securement mechanisms also may be utilized to secure or lock the connector 38 and pivot joint 42 into the desired linear positioning along the linear positioning assembly 34.

The pivot joint 40 also may be disposed in lateral slots, as discussed below with reference to FIGS. 4 and 5. However, as illustrated in FIGS. 1–3, the pivot joint 40 is rotatably coupled to the top portion 12 in a fixed position. In the recess 30 of the top portion 12, the pivot joint 40 has protruding portions 64 and 66 extending into receptacles 68 and 70. The collapsible connector 10 also may have any number of electrical contacts 20 and conductors 24 in the base portion 14 depending on the desired input/output configuration. In the embodiment of FIG. 2, the collapsible connector has contacts 72, 74, 76, 78, 80, and 82 disposed on the front bottom portion 22. The contacts 72–82 are electrically coupled to conductors 84, 86, 88, 90, 92, and 94, which extend through the base portion 14 to the cable 26 to provide an input/output connection to a desired component or device. For example, the collapsible connector 10 may be configured for an RJ11 or RJ45 communication device, which has four of the electrical contacts 20 and corresponding conductors 24.

The collapsible connector 10 of the present technique may utilize a variety of collapsible mechanisms to minimize space consumption of the electrical contacts 20 and mechanical coupling scheme in a closed configuration. FIG. 3 is a side view of the collapsible connector 10 in an open configuration 96, which has the top portion 12 rotated away from the base portion 14 about the hinge structure 16. As illustrated, the connector 38 provides support between the top portion 12 and the base portion 14 for maintaining the open configuration 96. As indicated by arrows 98, 100, and 102, the collapsible connector is oriented in the open configuration 96 by rotating the top portion 12 about the hinge structure 16 in the direction of the arrow 98, rotating the connector 38 about the pivot joint 40, and rotating and linearly moving the connector 38 along the linear positioning assembly 34 via the pivot joint 42, as indicated by the arrows 100 and 102. The collapsible connector 10 may be oriented in the closed configuration 18, as illustrated in FIG. 1, by performing the reverse of the above procedure to move the components of the collapsible connector 10 in the opposite direction of the arrows 98, 100, and 102.

It should also be noted that the top portion 12 and the base portion 14 may be formed from any suitable material, such as a plastic, which may form a catch portion 104 on the top portion 12. The catch portion 104 may simply be a flexible portion of plastic or it may have other catch mechanisms to secure the collapsible connector 10 in a desired receptacle in the open configuration 96. Therefore, in the open configuration 96, the catch portion 104 interacts with a desired receptacle of a cable or device to secure the collapsible connector 10 to the cable or device.

Figure 4:
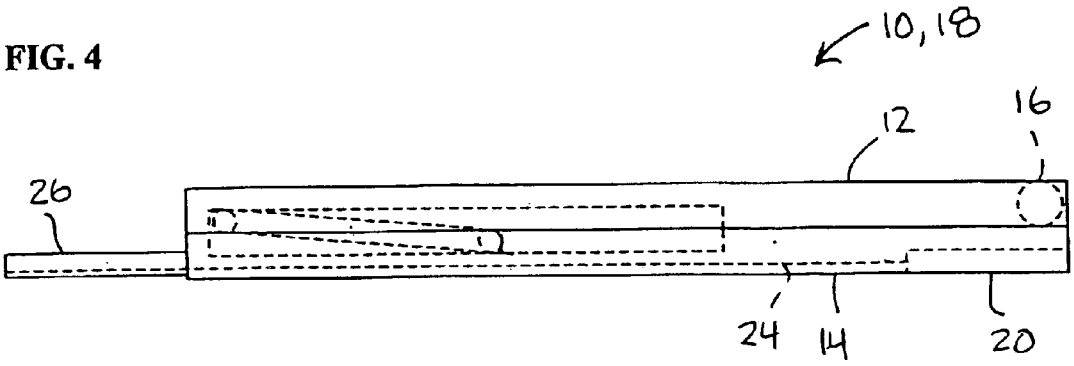
FIG. 4 is a side view of the collapsible connector in the closed configuration having an alternate configuration of the connector arm.
Figure 5:
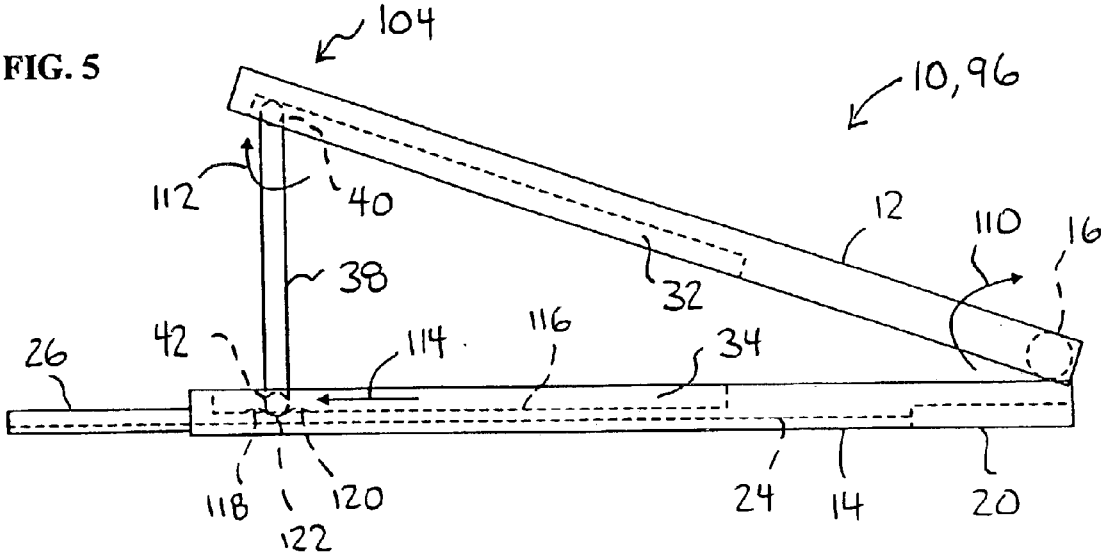
FIG. 5 is a side view of the collapsible connector illustrated in FIG. 4 in the open configuration.

An alternate configuration of the connector 38 and the pivot joints 40 and 42 is illustrated in FIG. 4, which is a side view of the collapsible connector 10 in the closed configuration 18. As illustrated, the connector 38 has the pivot joint 40 rotatably coupled to a rear portion 106 of the recess 32, while the pivot joint 42 is rotatably and movably coupled to a central portion 108 of the linear positioning assembly 34. In this alternate configuration, the collapsible connector 10 may be manipulated from the closed configuration 18 illustrated in FIG. 4 to the open configuration 96 illustrated in FIG. 5 by movement along arrows 110, 112, and 114. Accordingly, the top portion 12 may be rotated about the hinge structure 16 as indicated by the arrow 110, while the connector 38 may be rotated and moved to an upright orientation by rotation about the pivot joint 40 and by rotation and movement of the pivot joint 42 along the linear positioning assembly 34, as indicated by the arrows 112 and 114. Once the collapsible connector 10 is moved and positioned into the open configuration 96, the connector 38 can be locked into place by a variety of securement or locking mechanisms, such as discussed above with reference to FIG. 2. However, as illustrated in FIG. 5, a base 116 of the linear positioning assembly 34 may have protruding portions 118 and 120 disposed about a recess 122 to provide a pressure fit, or snap fit, of the pivot joint 42 at the desired location along the linear positioning assembly 34.

Figure 6:
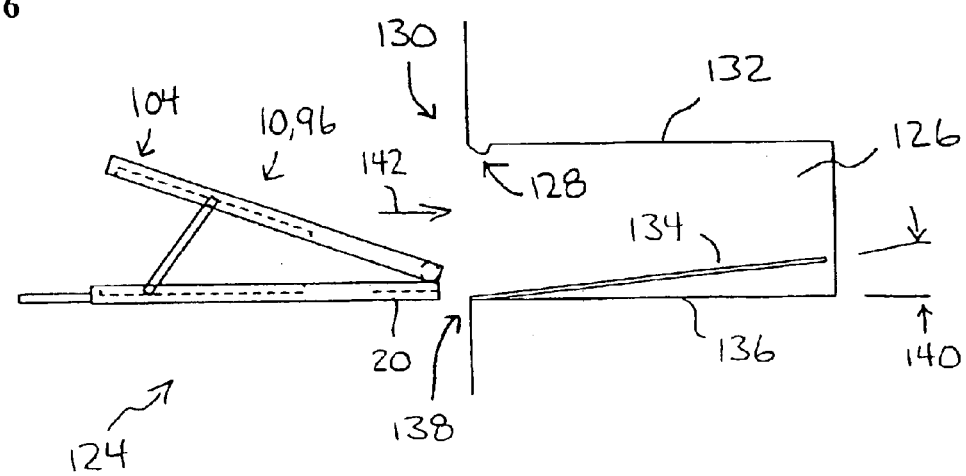
FIG. 6 is a side view of the collapsible connector in the open configuration and being inserted into an electrical receptacle.

An exemplary electrical coupling system 124 is illustrated in FIG. 6, which is a side view of the collapsible connector 10 being removably inserted into an electrical receptacle 126. Although the collapsible connector 10 may be configured for any suitable electrical receptacle, the electrical receptacle 126 illustrated in FIG. 6 has a protruding portion 128 disposed at a front edge 130 of a top 132. The protruding portion 128 catches the portion 104 of the collapsible connector 10 to secure the collapsible connector 10 in the receptacle 128. The receptacle 126 also has a set of electrical conductors 134 disposed at a bottom 136. The electrical conductors 134 may be coupled to the bottom 136 at a front edge 138 or at any other suitable location along the bottom 136. The conductors 134 also may be provided at an angle 140 to provide a spring force for pressurably coupling the conductors 134 with the electrical contacts 20 of the collapsible connector 10. Any other suitable spring mechanism or connector mechanism also may be utilized within the scope of the present technique.

Accordingly, as the collapsible connector 10 is inserted into the electrical receptacle 126, as indicated by arrow 142, the electrical contacts 20 pressurably contact the electrical conductors 134 and the catch portion 104 springably slides across the protruding portion 128. Once the entire collapsible connector 10 is disposed within the electrical receptacle 126, the catch portion 104 is secured behind the portion 128. The collapsible connector 10 can be removed from the electrical receptacle 126 by depressing the catch portion 104 below the protruding portion 128 and then withdrawing the collapsible connector 10 from the electrical receptacle 126.

Figure 7:
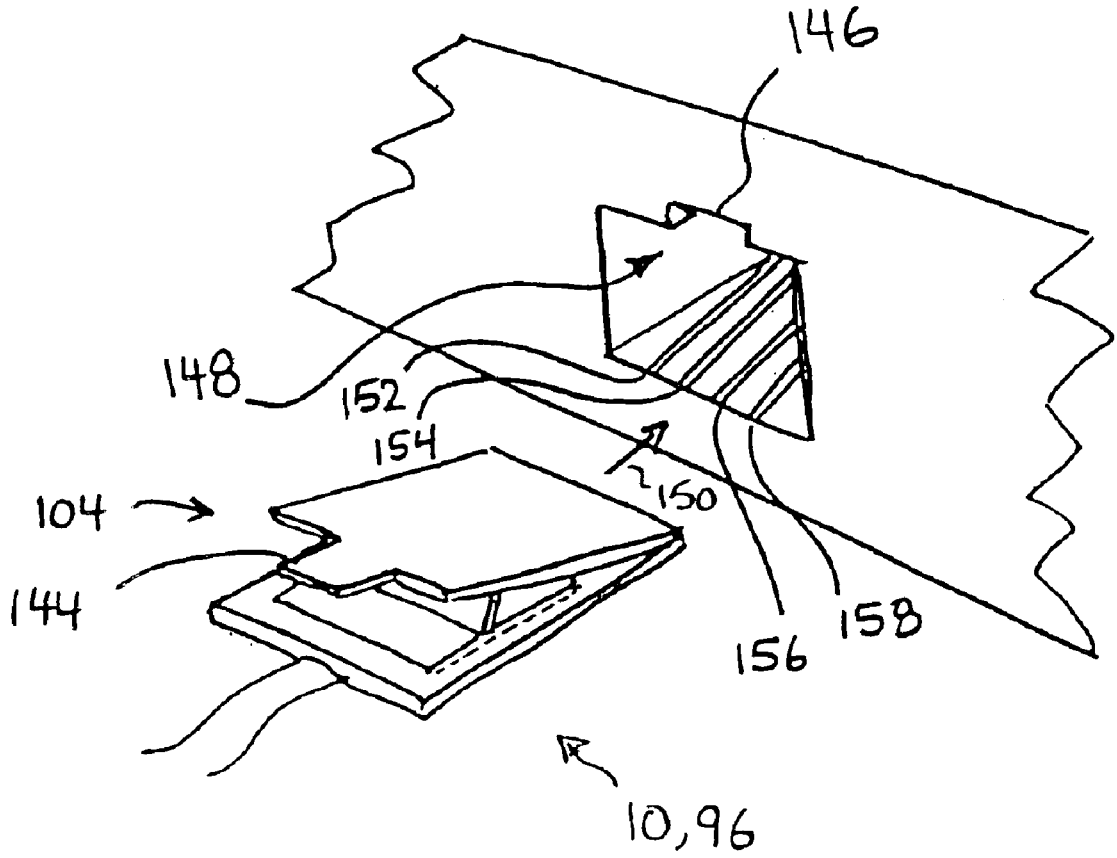
FIG. 7 is a perspective view of the collapsible connector illustrating an alternate embodiment of the top portion and connection mechanism being inserted into an alternate electrical receptacle.

FIG. 7 is a perspective view of an alternate embodiment of the collapsible connector 10 in the open configuration 96. As illustrated, the catch portion 104 of the top portion 12 has a tab section 144 formed in the top portion 12 to facilitate latching with a slot 146 of an electrical receptacle 148. Accordingly, the collapsible connector 10 may be inserted and latched into the electrical receptacle 148, as indicated by arrow 150. The tab section 144 is springably forced into the slot 146, while the adjacent portions 149 of the catch portion 104 are secured to the electrical receptacle 148 behind adjacent portions 151 of the slot 146. As illustrated, the collapsible connector 10 may be an RJ11 or RJ45 connector, while the electrical receptacle 148 may be the corresponding receptacle for that RJ11 or RJ45 connector. To remove the collapsible connector 10 from the electrical receptacle 148, the tab section 144 is depressed and the collapsible connector 10 is pulled outwardly from the electrical receptacle 148. The electrical receptacle 148 also has a plurality of electrical conductors, such as those illustrated in FIG. 6, which pressurably and electrically contact the electrical contacts 20 of the collapsible connector 10. For example, electrical conductors 152, 154, 156, and 158 are springably disposed in a lower portion of the electrical receptacle 148 for securely and continuously contacting the electrical contacts 20. Any other suitable mechanical coupling assembly also may be used within the scope of the present technique.

Figure 8:
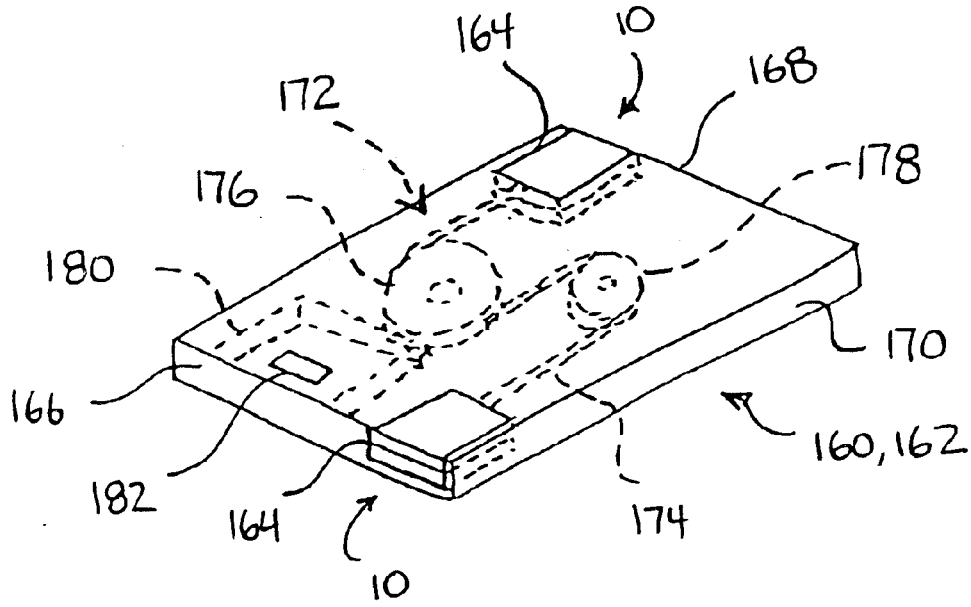
FIG. 8 is a perspective view of an extension cord carrier assembly having collapsible connectors coupled to opposite ends of a cable disposed in a wound configuration.

The collapsible connector 10 may be utilized in a variety of electronics, computing devices and components. FIG. 8 is a perspective view of an extension cord carrier assembly 160 having a pair of the collapsible connectors 10 in a closed configuration 162. As illustrated, the collapsible connectors 10 are disposed in receptacles 164 on opposite sides 166 and 168 of a housing 170. A reel assembly 172 is disposed within the housing 170 between the pair of collapsible connectors 10 for removably storing a cable 174, which is electrically coupled to the pair of the collapsible connectors 10. As illustrated, the cable 174 is wound about a pair of reels 176 and 178, which have a spring or winding assembly 180 to facilitate winding and unwinding of the cable 174. The winding assembly 180 also may have a release or securement switch 182 for automatically winding the cable 174 back into the housing 170 and for locking the cable 174 at a desired distance from the reel assembly 172. Any other suitable reel assembly 172 and winding assembly 180, either automatic or manual, also may be utilized within the scope of the present technique. It should also be noted that the extension cord carrier assembly 160 may be disposed in any suitable housing 170. For example, the housing 170 may be configured for insertion into a device slot (e.g., a PCMCI slot) of a computing device, such as a portable computing device or computer system.

Figure 9:
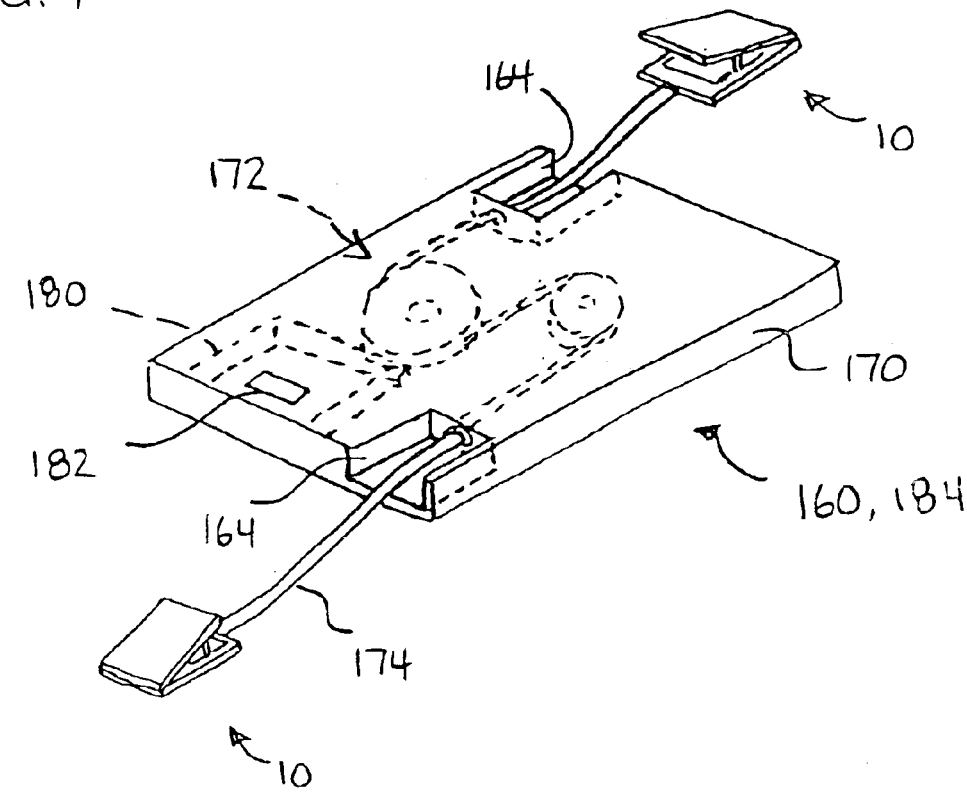
FIG. 9 is a perspective view of the extension cord carrier assembly illustrated in FIG. 8 having the cable unwound and the collapsible connectors removed from receptacles.

FIG. 9 is a perspective view of the extension cord carrier assembly 160 in an unwound configuration 184, which has the pair of the collapsible connectors 10 at least partially removed from the receptacles 164 of the housing 170. The pair of collapsible connectors 10 may be identical, as illustrated, or the one of the pair collapsible connectors 10 may include various pairs of male and female connector assemblies for a desired application. The reel assembly 172 also may have a manual winding assembly, rather than the spring assisted winding assembly 180 illustrated in FIGS. 8 and 9. In this unwound configuration 184, the switch 182 may be depressed to lock the cable 174 or to automatically rewind the cable into the housing 170 and about the reel assembly 172.

Figure 10:
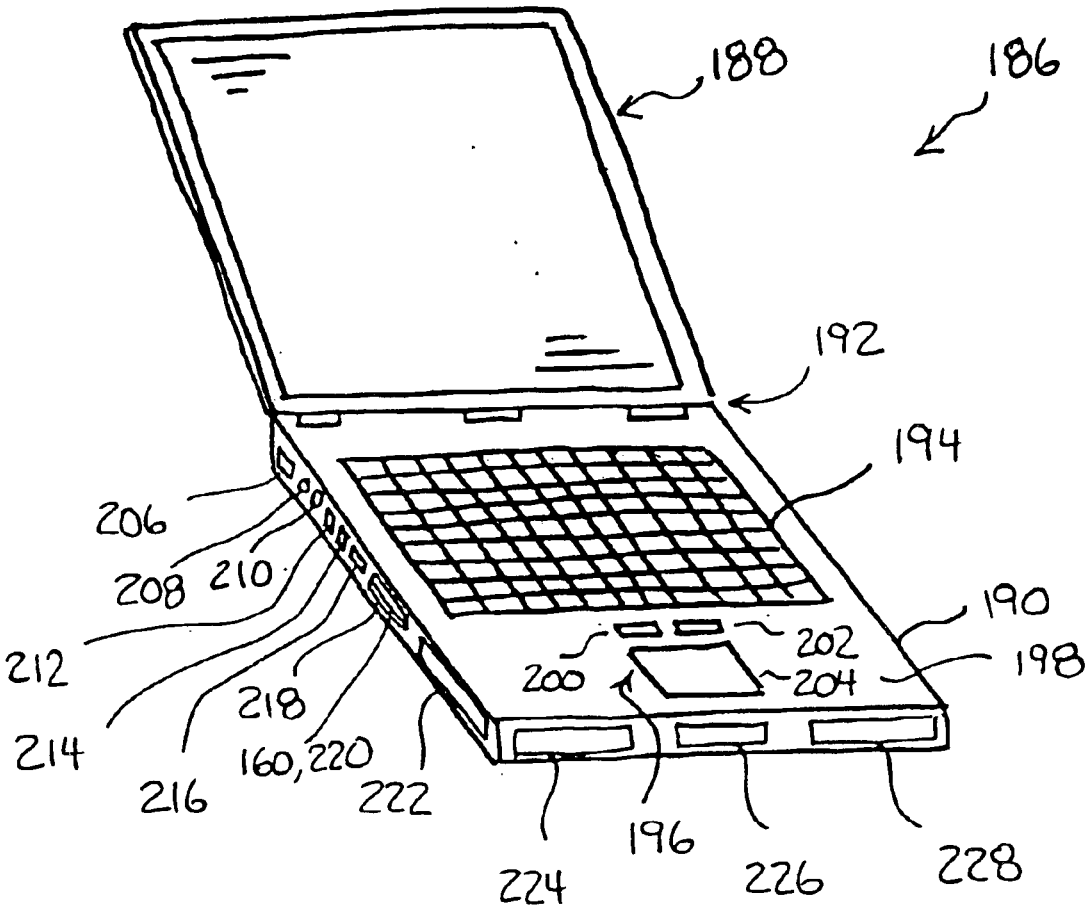
FIG. 10 is a perspective view of a computing device having receptacles for the extension cord carrier assembly and also having an extension cord assembly disposed in the housing of the computing device.

As discussed above, the collapsible connector 10 and the extension cord carrier assembly 160 may be utilized in a variety of electronics, computing devices and components, such as a portable computing device. FIG. 10 is a perspective view of a portable computing device 186 having a display 188 rotatably coupled to a housing 190 by a hinge structure 192. The portable computing device 186 also has a keyboard 194 and a pointing device 196 disposed in a top portion 198 of the housing 190. The pointing device 196 may include a variety of pointing mechanisms and buttons, such as buttons 200 and 202 and a touch pad 204. The portable computing device 186 also may have a variety of ports and bays, such as ports 206, 208, 210, 212, 214, and 216 and bays 218, 220, 222, 224, 226, and 228. The bays 218–228 also may have a variety of computing devices, such as network cards, modems, floppy drives, memory devices, and various other desired components for interaction with the portable computing device 186. For example, the extension cord carrier assembly 160 may be inserted into one of the slots 218 and 220, which may be a PMCIA slot. It should also be noted that one of the ports 206–216 may incorporate an extension cord assembly having the collapsible connector 10 coupled to a cable wound about a spring assisted winding assembly, such as the winding assembly 180 of the extension cord carrier assembly 160. This cable would then be electrically coupled to a desired internal component of the portable computing device 186. For example, port 206 may house an RJ11 or RJ45 connector having the collapsible mechanism of the collapsible connector 10. The RJ 11 or RJ45 connector would then be communicatively coupled to the desired communication device, such as a network card or modem. As described above, the collapsible connector 10 and the extension cord carrier assembly 160 may be utilized in a desktop or portable computer system, a personal digital assistant, or any other stationary or mobile electronic or computing device.

While the invention may be susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention as defined by the following appended claims.

What is claimed is:

1. A space saving system for providing a communication connection, comprising:

a collapsible communication connector having a v-shaped configuration of a mechanical connector panel collapsible to a substantially flat configuration with an electrical connector panel; and a communication cable coupled to the collapsible communication connector; and a reel assembly baying the communication cable removably wound about the reel assembly.

2. The space saving system of claim 1, wherein the mechanical connector panel is hingedly coupled to the electrical connector panel.

3. The space saving system of claim 1, wherein the mechanical connector panel comprises a securement portion configured for removably securing the collapsible communication connector to a counterpart communication connector.

4. The space saving system of claim 3, wherein the securement portion comprises a tab section configured for springably and removably securing the collapsible communication connector to a slot section of the counterpart communication connector.

5. The space saving system of claim 1, wherein the reel assembly is disposed in a computing device and the cable is communicatively coupled to a component of the computing device.

6. The space saving system of claim 5, wherein the computing device is a portable computer system.

7. The spare saving system of claim 1, wherein the reel assembly is disposed in a housing and a complementary communication connector is coupled to an end of the cable opposite the collapsible communication connector.

8. The space saving system of claim 7, wherein the reel assembly comprises an automatic winding assembly to retract the cable into the housing and about a reel.

9. The space saving system of claim 7, wherein the housing has a receptacle for removably storing the substantially flat configuration of the collapsible communication connector while the cable is retracted into the housing and wound about the reel assembly.

10. The space saving system of claim 7, wherein the housing has a structure configured for removable insertion into a slot of a computing device.

11. The space saving system of claim 10, wherein the slot comprises a device slot of a portable computing device.

12. The space saving system of claim 1, wherein the reel assembly comprises an automatic winding assembly to retract the cable into the housing and about a reel of the reel assembly.

13. A system, comprising:

a housing comprising a recess;

a communication cable extractable from and retractable into the housing; and a connector end coupled to the communication cable and comprising a v-shaped configuration of a mechanical connector panel collapsibly coupled to an electrical connector panel, wherein the v-shaped configuration of the connector end is collapsible to a substantially flat configuration of the mechanical and electrical connector panels, wherein the connector end is extractable from and retractable into the recess in the substantially flat configuration.

14. The system of claim 13, wherein the housing comprises a computer system.

15. The system of claim 13, wherein the housing comprises a card device far a portable computer.

16. The system of claim 13, wherein the housing comprises a cable reel mechanism having the communication cable wound thereabout.

17. The system of claim 13, wherein the connector end comprises an RJ/11 connector.

18. The system of claim 13, wherein the connector end comprises an RJ/45 connector.

19. The system of claim 13, wherein the mechanical connector panel comprises a tab portion latchable with a communication connector receptacle in the v-shaped configuration of the connector end.

* * * * *